US007382327B2

(12) United States Patent
Nelson

(10) Patent No.: US 7,382,327 B2
(45) Date of Patent: Jun. 3, 2008

(54) ANTENNA VIBRATION ISOLATION MOUNTING SYSTEM

(75) Inventor: Larry A. Nelson, Seattle, WA (US)

(73) Assignee: The Boeing Company, Chicago, IL (US)

( * ) Notice: Subject to any disclaimer, the term of this patent is extended or adjusted under 35 U.S.C. 154(b) by 38 days.

(21) Appl. No.: 11/164,309

(22) Filed: Nov. 17, 2005

(65) Prior Publication Data

US 2007/0109205 A1 May 17, 2007

(51) Int. Cl.
*H01Q 1/34* (2006.01)
*H01Q 1/42* (2006.01)
*H01Q 1/12* (2006.01)

(52) U.S. Cl. ..... 343/709; 343/872; 343/878

(58) Field of Classification Search ..... 343/709, 343/872, 878

See application file for complete search history.

(56) References Cited

U.S. PATENT DOCUMENTS 4,775,867 A * 10/1988 Sokol et al. ..... 343/786
7,104,515 B2 * 9/2006 Harless et al. ..... 248/562

* cited by examiner

*Primary Examiner*—Shih-Chao Chen
(74) *Attorney, Agent, or Firm*—Ostrager Chong Flaherty & Broitman P.C.

(57) ABSTRACT

A vibration isolation system for the antenna of a vehicle, such as a maritime vessel. The vibration isolation system has a staged construction that slidably attaches the maritime antenna to a maritime vessel along up to three independent axes of translation. This staged construction is adapted for independently decreasing movement of the antenna along the independent axes of translation. Accordingly, the staged construction prevents the antenna from rotating due to induced translational vibration and thus enhances the pointing performance for the antenna.

19 Claims, 6 Drawing Sheets

ANTENNA VIBRATION ISOLATION MOUNTING SYSTEM

FIELD OF THE INVENTION

The present invention relates generally to vibration isolation systems for mounting antenna assemblies to moving vehicles, such as maritime vessels.

BACKGROUND

Satellite antenna manufacturers are investigating high-frequency broadband satellite services for maritime vessels. In particular, spectrum in Ku Band and Ka Band is substantially broad and predominantly unused so as to provide an opportunity for economic broadband service.

High-frequency satellite transmissions typically increase the directivity of the satellite antenna. In this regard, the high-frequency transmissions typically can be received by the antenna only when the antenna is accurately pointed at the satellite. It is understood that the high degree of pointing accuracy increases the difficulty in both positioning the antenna and providing a long-term durable antenna. Namely, existing antenna, such as those on a vessel, receive vibrations that can sufficiently perturb the pointing direction or transmission toward the satellite.

With attention to FIGS. 1 and 2, one known antenna assembly 10 includes a spring suspension system 12 between an antenna 14 and a mast 16. As shown in FIG. 1, the spring suspension system 12 includes a series of springs 18 isolating vibration at the base 20 of the antenna 14 with the center of gravity 22 of the antenna 14 above the spring suspension system 12. Accordingly, the antenna 14 is somewhat movable on the mast 16 with the spring suspension system 12 affecting movement of the antenna 14. These springs 18 can be somewhat large with generally low coefficients of stiffness for minimizing low frequency vibrations. However, also in this regard, the antenna 14 deflects or sags in response to gravity and accelerations that are induced by ship motion. Examples of typical ship motion include roll, pitch, yaw, heave, surge, and sway. Referring now to FIG. 3, ship motion can cause antenna deflection and thus increase stabilization requirements for correcting the deflection or otherwise prevent the antenna from tracking a satellite under predetermined ship motions.

It will be appreciated that sufficiently large and soft springs 18 with resonances generally less than 4 Hz can typically attenuate the low-frequency vibration approximately between 4 Hz and 200 Hz. The vibrations typically are produced by rotating mechanisms of the vessel, such as the propeller, shaft, or engine assemblies. In particular, low-frequency vibrations can be transmitted from the propeller to the antenna assembly via structural components of the vessel. In addition, vibrations are also affected by sea conditions, vessel maneuvering, and vessel loading. However, the ship motion can cause the springs 18 to have substantially large deflections thereby requiring a significantly sized radome 24 and also producing a significant loss of tracking range. Pointing errors caused by the springs are greatest at low frequencies as deflection from vibration is proportional to acceleration divided by the vibration frequency squared. Accordingly, existing spring suspension systems 12 typically are tuned for isolating high-frequency vibration for providing durability rather than low-frequency vibration that provides pointing accuracy.

Referring back to FIGS. 1 and 2, the springs 18 are configured for rotating the antenna 14 and decreasing vibration stress. In particular, FIGS. 4 through 6 respectively show the wobble mode, the dangle mode, and the piston mode for the antenna 14. In these examples, the X-axis is positioned athwartship, with the Y-axis aligned along the longitudinal axis of the vessel and the Z-axis being vertical and aligned with gravity. The first two isolation modes about the X and Y-axes are similar in that each has a center of gravity substantially above the base 20 of the antenna 14. For this reason, vibration stress relief occurs through rotation for lateral and longitudinal vibration. Translational acceleration at the base 20 of the antenna 14 is not significantly affected by the lowest isolation mode.

Referring now to FIG. 7, there is shown a matrix of exemplary graphs for the transmittance of vibration to rotation of the antenna 14 at the base 20 and a top portion 26 of the antenna 14, respectively indicated by curve 28*a* and curve 28*b*. The X and Y inputs can produce rotation of the antenna 14, which is indicated by the difference between curve 28*a* and curve 28*b*. The relief of vibration stress by rotation creates small pointing changes.

Referring now to FIG. 8, it will be appreciated that the mass distribution of the antenna 14 (shown in FIG. 3) in conjunction with the movement of the antenna 14 typically cause additional rotational torque Rx, Ry, Rz about the respective axes. The rotational torque typically rotates the antenna 14 and thus adversely affects the pointing accuracy of the antenna 14. Rotation of the antenna 14 typically is prevented by pointing control mechanisms that apply corrective torque. Further, it is understood rotations that are induced by vibration occur at substantially high frequencies, namely from about 4 to 200 Hz. Accordingly, the spring suspension system 12 and pointing control mechanisms may require substantially high bandwidth control loops and significantly high torques for accurately pointing the antenna 14. This leads to larger motors, increased heat, higher cost, larger weight, increased power consumption and generally shortened life for antenna assembly drive components.

It would, therefore, be highly desirable to provide a vibration isolation system for an antenna assembly that enhances the pointing and tracking range and accuracy performance of the antenna assembly during use on a vehicle or vessel and minimizes the wear and control torque requirements on the same.

SUMMARY OF THE INVENTION

An embodiment of the invention is a vibration isolation system for a maritime antenna assembly which is space stabilized to point at a geosynchronous satellite or other suitable location. The vibration isolation system has a staged construction that slidably attaches an antenna to a maritime vessel or other vehicle along up to three independent axes of translation. This staged construction is adapted for preventing the antenna from rotating and thus enhances the pointing performance for the antenna.

One advantage of the claimed invention is that a vibration isolation system is provided that improves the pointing and tracking accuracy of an antenna mounted to a maritime vessel.

Another advantage of the claimed invention is that a vibration isolation system is provided that enhances tracking range of antenna under various movement, e.g. ship motion.

Yet another advantage of the claimed invention is that a vibration isolation system is provided that minimizes the wear on a maritime antenna assembly.

Another advantage of the claimed invention is that a vibration isolation system minimizes motor torque required for pointing control of the antenna.

Yet another advantage of the claimed invention is that a vibration isolation system is provided that eliminates the angular component of the quasi-static sag typically associated with vibration isolation for a maritime antenna assembly.

Still another advantage of the claimed invention is that a vibration isolation system is provided that allows a smaller radome to enclose a maritime antenna.

The features, functions, and advantages can be achieved independently and in various embodiments of the present invention or may be combined in yet other embodiments.

BRIEF DESCRIPTION OF THE DRAWINGS

For a more complete understanding of this invention, reference should now be made to the embodiments illustrated in greater detail in FIGS. 9 through 12 and described below by way of examples of the invention.

DETAILED DESCRIPTION OF THE INVENTION

Figure 1:
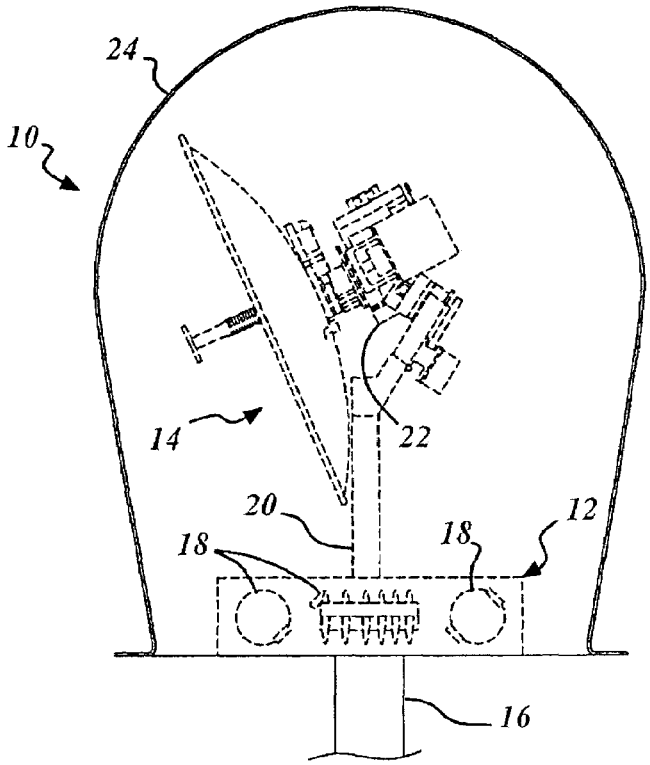
FIG. 1 PRIOR ART
FIG. 1 is a side view of a satellite antenna assembly having a conventional spring suspension system for rotating the satellite antenna assembly to enhance pointing accuracy.
Figure 2:
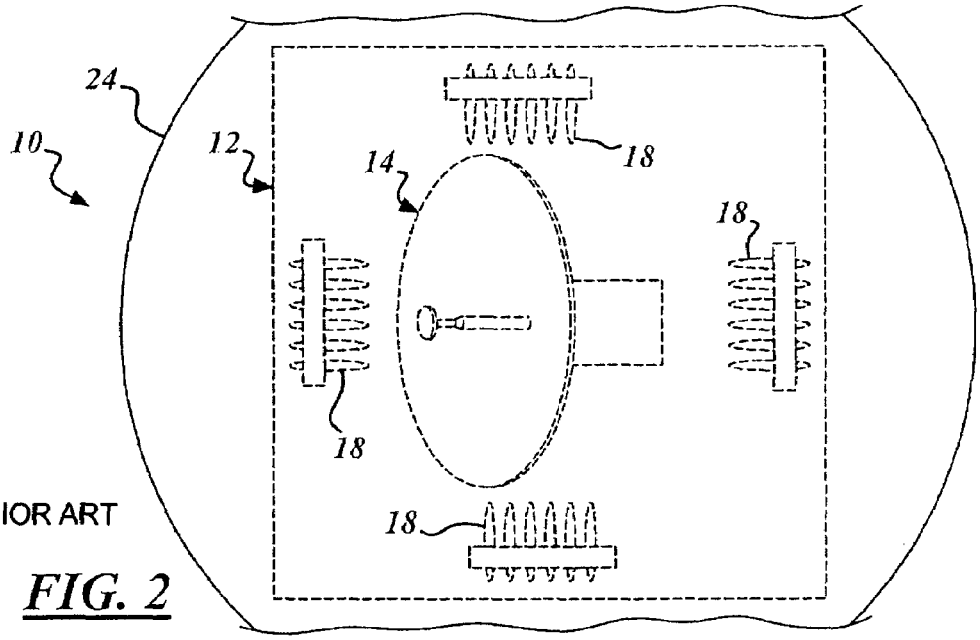
PRIOR ART FIG. 2
FIG. 2 is a top view of the satellite antenna assembly shown in FIG. 1.
Figure 3:
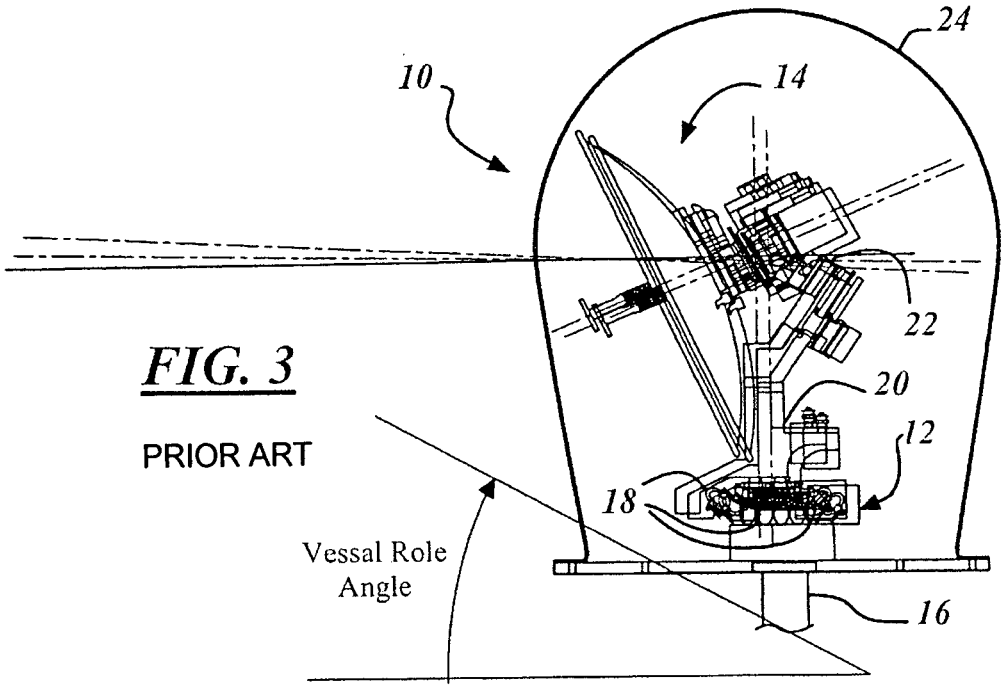
FIG. 3 PRIOR ART
FIG. 3 is a plan view of the satellite antenna assembly shown in FIG. 1, illustrating the deflection of the satellite antenna within the radome.
Figure 4:
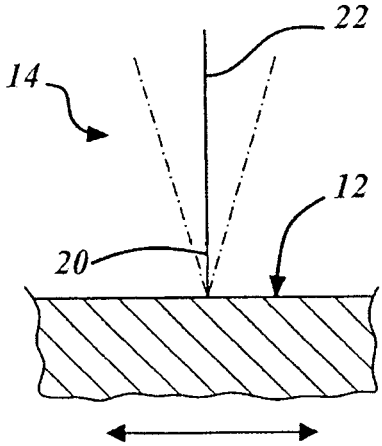
FIG. 4 PRIOR ART
FIG. 4 is a schematic view of the satellite antenna shown in FIG. 1, illustrating the satellite antenna vibrating in a wobble mode with rotation centered near the base of the antenna.
Figure 5:
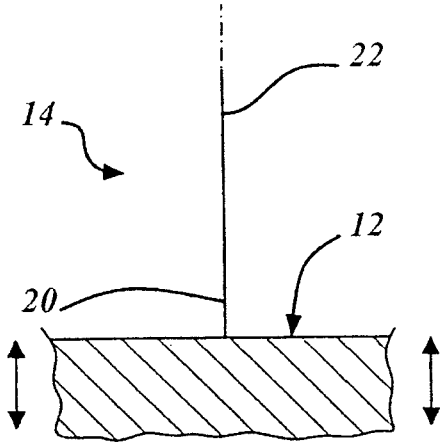
FIG. 5 PRIOR ART
FIG. 5 is a schematic view of the satellite antenna shown in FIG. 1, illustrating the satellite antenna vibrating in a piston mode with translation of the antenna in a vertical direction.
Figure 6:
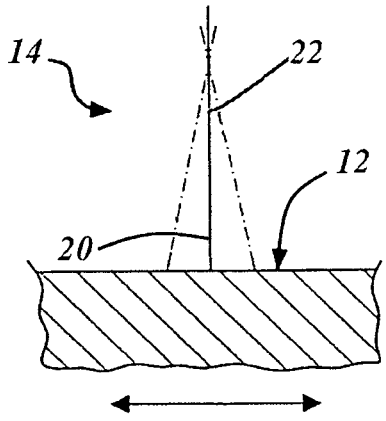
FIG. 6 PRIOR ART
FIG. 6 is a schematic view of the satellite antenna shown in FIG. 1, illustrating the satellite antenna vibrating in a dangle mode with rotation centered near the top of the antenna.
Figure 7:
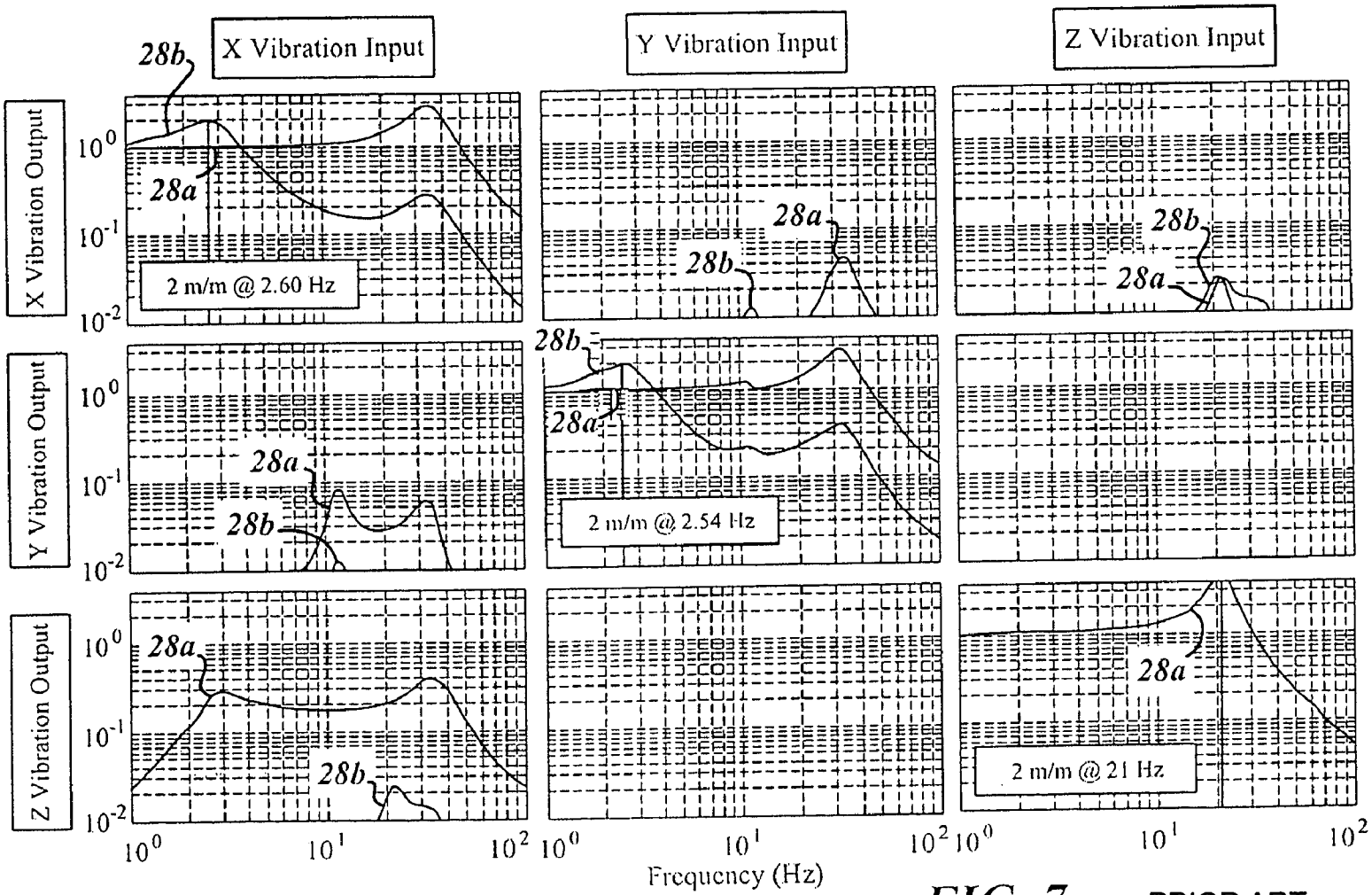
FIG. 7 PRIOR ART
FIG. 7 is a matrix of exemplary graphs for the satellite antenna assembly shown in FIG. 1, illustrating the transmissibility of vibration of the vessel to vibration of the satellite antenna along X, Y, and Z axes.
Figure 8:
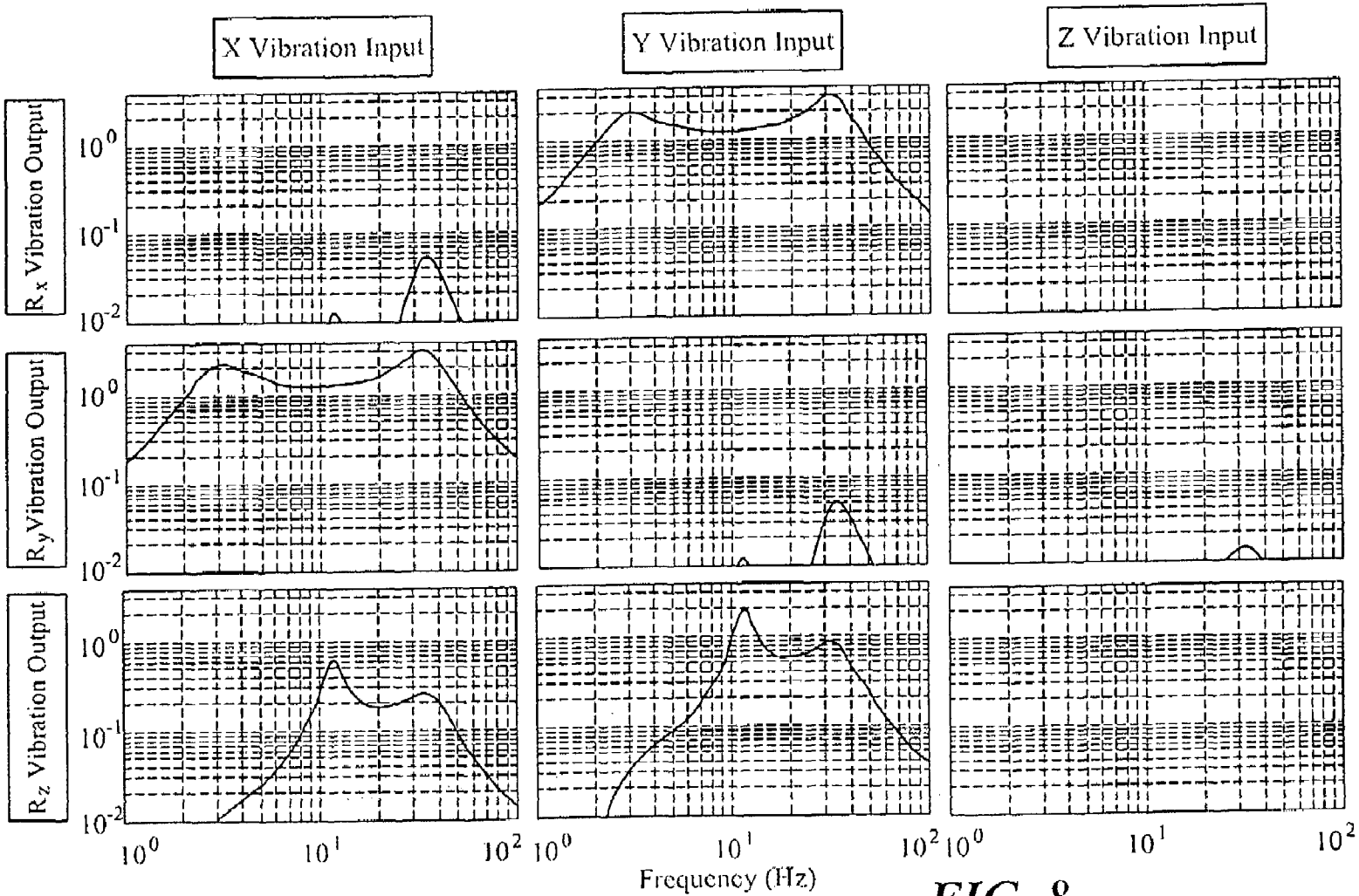
FIG. 8 PRIOR ART
FIG. 8 is a matrix of exemplary graphs for the satellite antenna assembly shown in FIG. 1, illustrating the transmissibility of vibration of the vessel to rotation on the satellite antenna assembly along X, Y, and Z axes.

In the following figures, the same reference numerals are used to identify the same or similar components in the various representative views.

The present invention is particularly suited for a vibration isolation system for use in mounting a satellite antenna to a vehicle in motion, such as a maritime vessel on the high seas. In this regard, the embodiments described herein employ features where the context permits, e.g. when a specific result or advantage of the claimed invention is desired. However, it is contemplated that the vibration isolation system can instead be utilized for attaching various other objects to other vehicles, buildings, or other suitable structures. To that end, a variety of other embodiments are contemplated having different combinations of the described features, having features other than those described herein, or even lacking one or more of those features.

Figure 9:
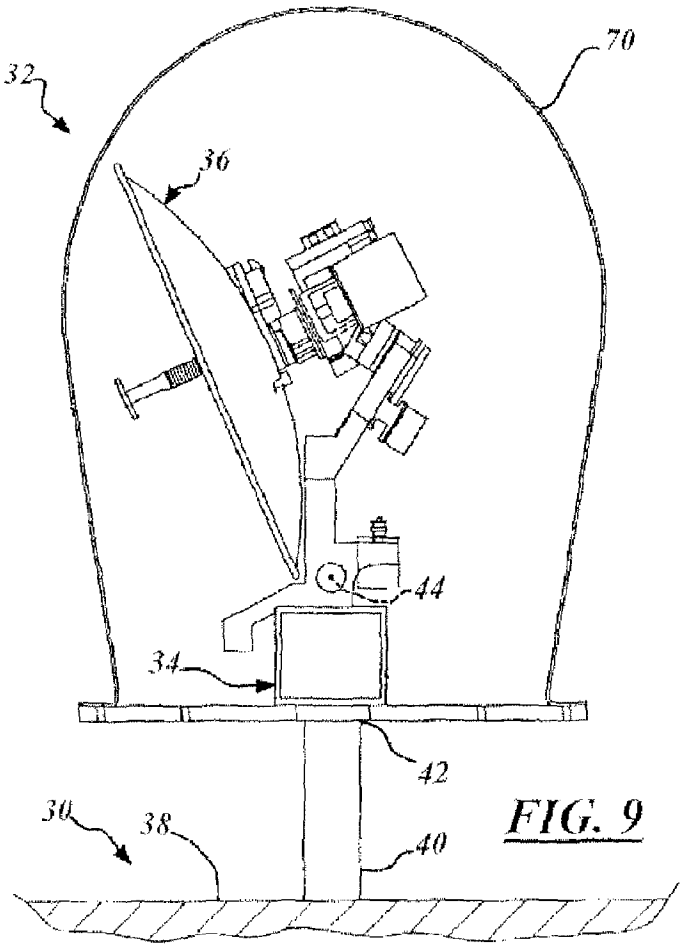
FIG. 9 is a schematic plan view of a maritime vessel having a vibration isolation system with a satellite antenna mounted thereon, according to one advantageous embodiment of the claimed invention.

Referring to FIG. 9, there is shown a maritime vessel 30 having an antenna assembly 32 comprised of a vibration isolation system 34 ("VIS") and a satellite antenna 36. In particular, the vessel 30 has a deck 38 with a generally long mast 40 extending therefrom. The mast 40 has a top end 42 with the VIS 34 and the antenna 36 mounted thereon. In this way, the antenna 36 has a generally unobstructed field of view of orbiting satellites, including those that are near the horizon.

As detailed below, the VIS 34 improves the pointing performance of the antenna 36 and also minimizes the wear on the antenna 36. The VIS 34 is configured for providing the antenna 36 with to up three translational degrees of freedom. In other words, the VIS 34 slidably attaches the antenna 36 to the mast 40 along three independent axes without producing angular motion or sagging of the antenna 36. It is contemplated that the VIS 34 can instead be configured for providing less than three translational degrees of freedom. Also, the VIS 34 is adapted for preventing the antenna 36 from rotating about a body reference axis line 44 that extends through the antenna 36 and therefore enhances the pointing performance of the antenna 36. In this embodiment, the body reference axis line 44 extends through the footing of the antenna 36 out of the plane of the figure. Put another way, the VIS 34 prevents the antenna from wobbling or dangling on the mast 40 and thus enhances the pointing and tracking performance of the antenna 36. It is understood that conventional vibration isolation systems rotate and/or oscillate under ship motion.

Figure 10:
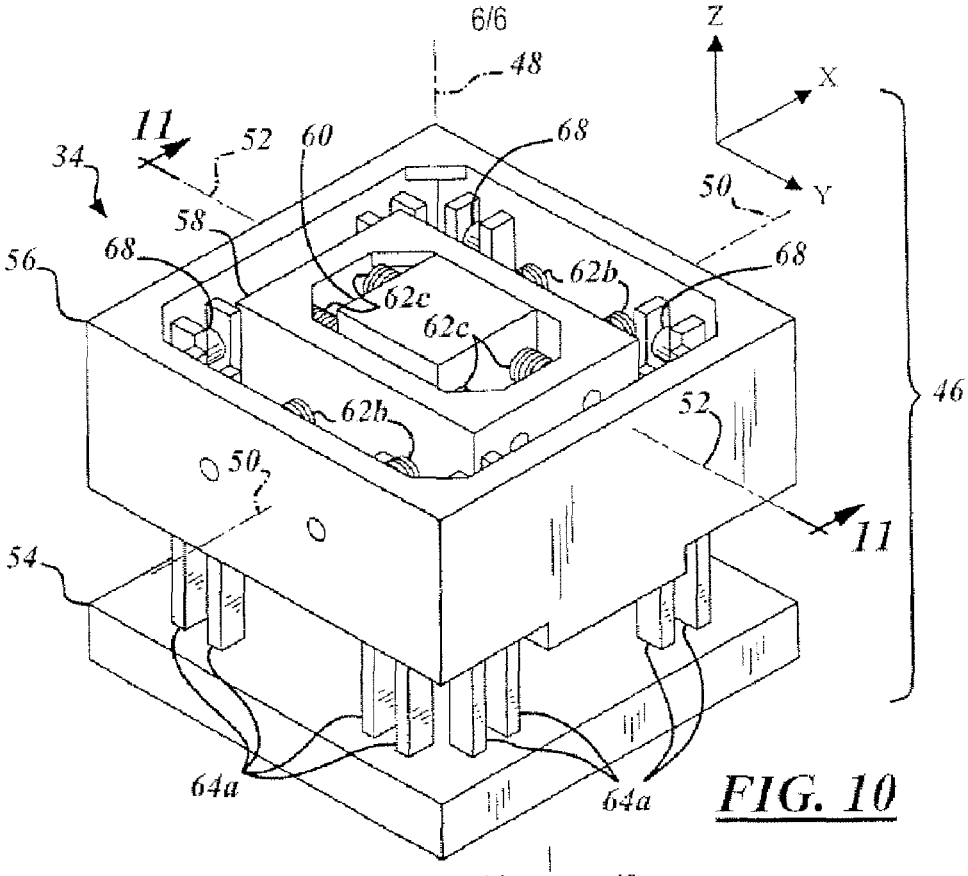
FIG. 10 is a perspective view of the vibration isolation system schematically shown in FIG. 9.

Referring now to the embodiment shown in FIG. 10, the VIS 34 has a staged construction 46 for isolating three translational degrees of freedom, namely a first axis 48, a second axis 50, and a third axis 52. This staged construction 46 is comprised of a base 54, an outer stage 56, an intermediate stage 58, a payload platform 60, and a series of springs 62*a* (shown in FIG. 11), 62*b*, and 62*c* (shown in FIG. 10). In this embodiment, the springs 62*a*, 62*b*, and 62*c* have a helical configuration. However, it is understood that the springs 62*a*, 62*b*, and 62*c* can instead be leaf springs or other suitable resilient members as desired.

Figure 11:
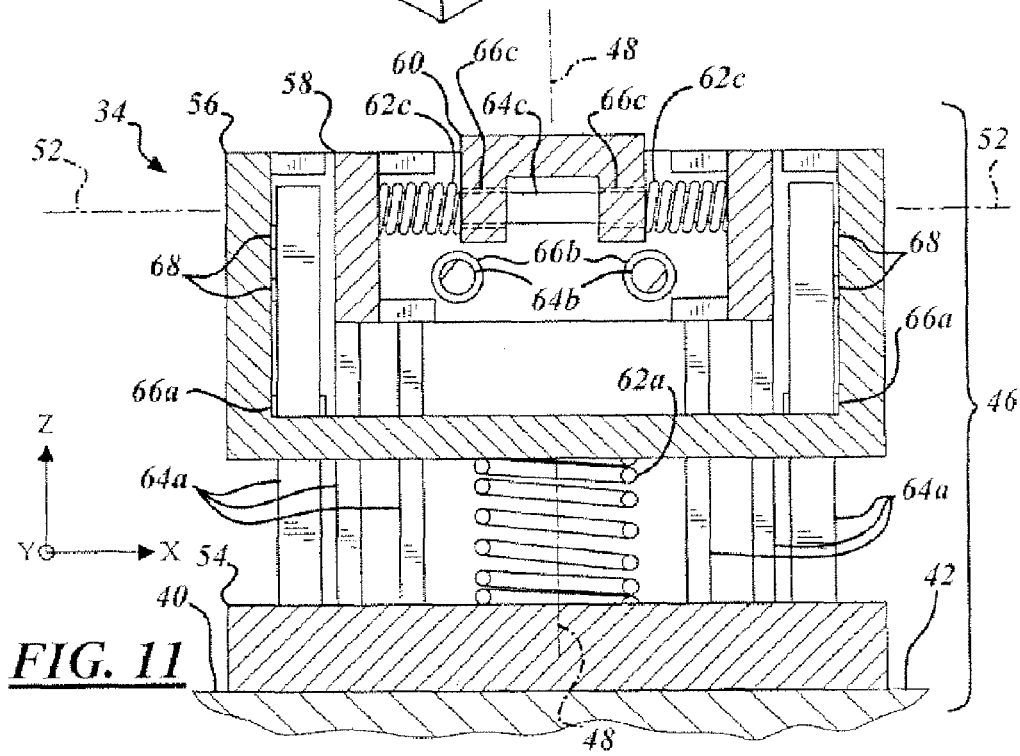
FIG. 11 is a cross-sectional view of the vibration isolation system shown in FIG. 10, as taken along line 10-10.

With attention now to FIG. 11, the base 54 is fixedly attached to the top end portion 42 of the mast 40. The base 54 is slidably attached to the outer stage 56 along the first axis 48, e.g. along the Z-axis. In this embodiment, the base 54 has one or more guiding rods 64*a*, which are slidable through one or more bushings 66*a* within the outer stage 56. The base 54 and the outer stage 56 also have one or more rolling mechanisms 68 therebetween for moving the outer stage 56 along the first axis 48. It will be appreciated that the base 54 can instead be slidably attached to the outer stage 56 by a variety of other suitable fastening means.

Furthermore, the base 54 and the outer stage 56 have a spring 62*a* (shown in FIG. 11) therebetween for attenuating translational vibration along the first axis 48. To that end, the spring 62*a* has a predetermined stiffness for attenuating a predetermined order of vibration. Similarly, the remaining springs 62*b*, 62*c* (as best shown in FIG. 10) have a predetermined stiffness for attenuating respective vibrations. Moreover, the base 54, the outer stage 56, the intermediate stage 58, and the payload platform 60 have a predetermined mass and are sized and shaped for attenuating the predetermined vibration. In this embodiment, the staged construction 46 is tuned for substantially attenuating vibration to a low-frequency. It is understood that the staged construction 46 can have various other configurations and applications as desired. The springs 62*a*, 62*b*, and 62*c* can have various suitable coefficients of stiffness or other suitable damping characteristics according to the application and optionally may have associated tuned damper assemblies to prevent excessive motion at resonance.

The intermediate stage 58 is slidably attached to the outer stage 56 along the second axis 50 (as best shown in FIG. 11), e.g. the X-axis. This second axis 50 is substantially perpendicular to the first axis 48. In this embodiment, with attention to FIG. 11, the outer stage 56 has one or more guiding rods 64*b* that are slidable through one or more respective bushings 66*b* within the intermediate stage 58. Also, the outer stage 56 and the intermediate stage 58 have one or more springs 62*b* (shown in FIG. 10) therebetween for attenuating translational vibration along the second axis 50. It will be appreciated that the base 54 can instead be slidably attached to the outer stage 56 by a variety of other suitable fastening means. The springs 62*a*, 62*b*, and 62*c* can have various suitable coefficients of stiffness or other suitable damping characteristics according to the application and optionally may have associated tuned damper assemblies to prevent excessive motion at resonance.

The payload platform 60 is slidably attached to the intermediate stage 58 along the third axis 52, e.g. the Y-axis. The third axis 52 is substantially perpendicular to the second axis 50. Referring to FIG. 11, the payload platform 60 has one or more guiding rods 64*c* that are slidable through one or more respective bushings 66*c* within the payload platform 60. Also, the intermediate stage 58 and the payload platform 60 have one or more springs 62*c* therebetween for attenuating translational vibration along the third axis 52. It is contemplated that the payload platform 60 can instead be slidably attached to the intermediate stage 58 by a variety of other suitable fastening means. The springs 62*a*, 62*b*, and 62*c* can have various suitable coefficients of stiffness or other suitable damping characteristics according to the application and optionally may have associated tuned damper assemblies to prevent excessive motion at resonance.

Referring back to FIG. 9, it will be appreciated that the VIS 34 may produce substantial translation. However, the VIS 34 does not produce angular motion of the antenna. In this regard, the radome 70 is sized to provide sufficient clearance for the antenna 36 and the antenna 36 remains accurately pointed toward a predetermined satellite notwithstanding ship motion and various other accelerations.

Figure 12:
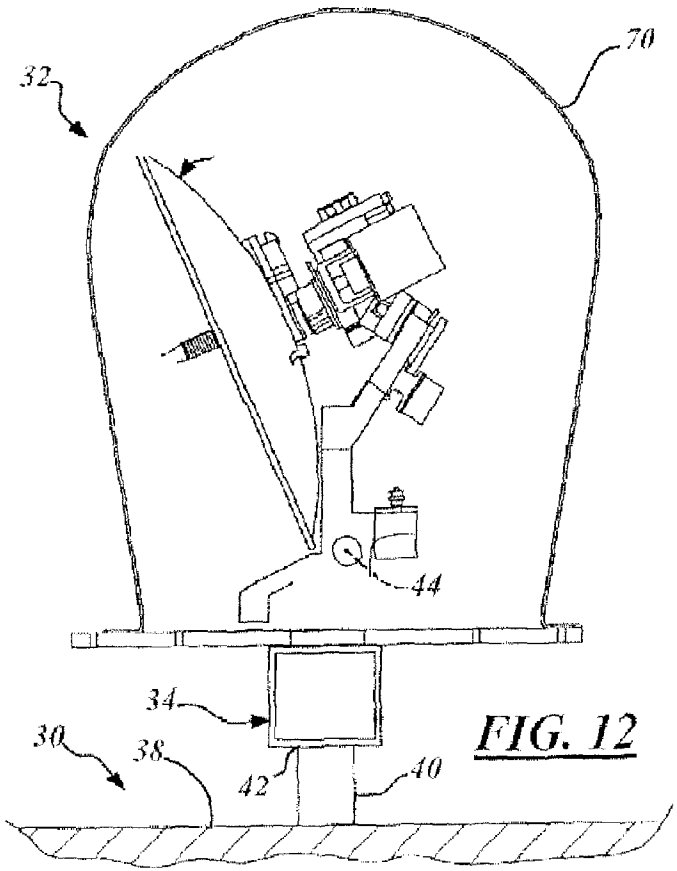
FIG. 12 is a schematic plan view of a maritime vessel having a vibration isolation system with a satellite antenna mounted thereon, according to an alternative embodiment of the claimed invention.

With attention to the embodiment shown in FIG. 12, shows the VIS 34 may be placed under the radome 70 so as to isolate the vibration from both the antenna 36 and the radome 70. In this configuration, the radome 70 can have a substantially compact construction.

While particular embodiments of the invention have been shown and described, numerous variations and alternate embodiments will occur to those skilled in the art. Accordingly, it is intended that the invention be limited only in terms of the appended claims.

What is claimed is:

1. A vibration isolation system for mounting an antenna to a maritime vessel, comprising:

a staged construction slidably mounting said antenna to said maritime vessel for allowing translational movement along a plurality of independent axes of translation; said staged construction independently damping vibration of said antenna along said independent axes of translation; said staged construction being adapted to not allow angular motion of said antenna relative to said axes of translation, wherein said staged construction is comprised of:

a base;

a payload platform with said antenna mounted thereon;

said payload platform being slidably mounted to said base along said plurality of independent axes of translation;

said base preventing said payload platform from rotating.

2. The vibration isolation system as recited in claim 1 wherein said payload platform is slidably mounted to said base by an outer stage and an intermediate stage.

3. The vibration isolation system as recited in claim 1 wherein said staged construction is further comprised of:

an outer stage slidably mounted to said base along a first axis.

4. The vibration isolation system as recited in claim 3 wherein one of said outer stage and said base has at least one guiding rod and the other of said outer stage and said base has at least one bushing with said at least one guiding rod slidable therethrough.

5. The vibration isolation system as recited in claim 3 wherein said outer stage is mounted to said base by at least one resilient member.

6. The vibration isolation system as recited in claim 3 wherein said staged construction is further comprised of:

an intermediate stage slidably mounted to said outer stage along a second axis substantially perpendicular to said first axis.

7. The vibration isolation system as recited in claim 6 wherein one of said intermediate stage and said outer stage has at least one guiding rod and the other of said intermediate stage and said outer stage has at least one bushing with said at least one guiding rod slidable therethrough.

8. The vibration isolation system as recited in claim 6 wherein said intermediate stage is supported on said outer stage by at least one resilient member.

9. The vibration isolation system as recited in claim 6 wherein said payload platform is slidably mounted to said intermediate stage along a third axis that is substantially perpendicular to said second axis.

10. The vibration isolation system as recited in claim 9 wherein one of said payload platform and said intermediate stage has at least one guiding rod and the other of said payload platform and said intermediate stage has at least one bushing with said at least one guiding rod slidable therethrough.

11. The vibration isolation system as recited in claim 9 wherein said payload platform is supported on said intermediate stage by at least one resilient member.

12. An antenna assembly comprising:

said vibration isolation system as recited in claim 1 having said antenna; and a radome surrounding said antenna and said staged construction;

said staged construction being configured for preventing said antenna from colliding into said radome during low-frequency vibration.

13. The antenna assembly as recited in claim 12 wherein said staged construction is comprised of:

a base; and a payload platform with said antenna mounted thereon;

said payload platform being slidably mounted to said base along said plurality of independent axes of translation;

said base preventing said payload platform from rotating.

14. The antenna assembly as recited in claim 12 wherein said payload platform is slidably mounted to said base by an outer stage and an intermediate stage.

15. A maritime vessel comprising:

a deck; and a mast extending from said deck and having a top end;

said vibration isolation system recited in claim 1 mounted on said top end of said mast;

said vibration isolation system minimizing a transmissibility of lateral deck vibration to antenna vibration.

16. A vibration isolation system for mounting an antenna to a maritime vessel, comprising:

a staged construction slidably mounting said antenna to said maritime vessel along up to three independent axes of translation;

said staged construction independently attenuating vibration of said antenna along each of said independent axes of translation;

said staged construction being adapted to not allow said antenna to rotate relative to said axes of translation during low frequency vibration, wherein said staged construction is comprised of:

a base;

an outer stage slidably mounted to said base along a first axis;

an intermediate stage slidably mounted to said outer stage along a second axis that is substantially perpendicular to said first axis;

a payload platform with said antenna mounted thereon;

said payload platform being slidably mounted to said intermediate stage along a third axis that is substantially perpendicular to said second axis;

said payload platform preventing said antenna from rotating.

17. The vibration isolation system as recited in claim 16 further comprising:

at least one guiding rod;

at least one bushing;

said at least one guiding rod and said at least one bushing slidably coupling at least two of said base, said outer stage, said intermediate stage, and said payload platform; and at least one guiding roller mechanism between at least two of said base, said outer stage, said intermediate stage, and said payload platform.

18. The vibration isolation system as recited in claim 16 further comprising at least one resilient member between at least two of said base, said outer stage, said intermediate stage, and said payload platform and preventing transmission of translation vibration into rotation of said antenna.

19. An antenna assembly comprising:

an antenna;

a staged construction slidably mounting said antenna to a maritime vessel along at least three independent axes of translation;

said staged construction independently attenuating vibration of said antenna along said at least three independent axes of translation;

said antenna having a body reference axis line therethrough;

said staged construction being adapted to not allow angular motion of said antenna about said body reference axis line, wherein said staged construction is comprised of:

a base;

an outer stage slidably mounted to said base along a first axis;

an intermediate stage slidably mounted to said outer stage along a second axis substantially perpendicular to said first axis;

a payload platform with said antenna mounted thereon;

said payload platform being slidably mounted to said intermediate stage along a third axis substantially perpendicular to said second axis;

said payload platform not allowing said antenna to rotate;

at least one guiding rod;

at least one bushing;

said at least one guiding rod and said at least one bushing slidably coupling at least two of said base, said outer stage, said intermediate stage, and said payload platform;

at least one guiding roller mechanism between at least two of said base, said outer stage, said intermediate stage, and said payload platform; and at least one resilient member between at least two of said base, said outer stage, said intermediate stage, and said payload platform and preventing transmission of translation vibration into rotation of said antenna during low frequency vibration.

* * * * *